US012509892B2

(12) United States Patent
Müller

(10) Patent No.: US 12,509,892 B2
(45) Date of Patent: Dec. 30, 2025

(54) FAIL-SAFE STABILITY MONITORING FUNCTION FOR A THICK MATTER CONVEYING SYSTEM

(71) Applicant: Putzmeister Engineering GmbH, Aichtal (DE)

(72) Inventor: Ansgar Müller, Aichtal (DE)

(73) Assignee: Putzmeister Engineering GmbH, Aichtal (DE)

( * ) Notice: Subject to any disclaimer, the term of this patent is extended or adjusted under 35 U.S.C. 154(b) by 249 days.

(21) Appl. No.: 18/552,044

(22) PCT Filed: Mar. 21, 2022

(86) PCT No.: PCT/EP2022/057308
§ 371 (c)(1),
(2) Date: Sep. 22, 2023

(87) PCT Pub. No.: WO2022/200253
PCT Pub. Date: Sep. 29, 2022

(65) Prior Publication Data

US 2024/0200347 A1 Jun. 20, 2024

(30) Foreign Application Priority Data

Mar. 23, 2021 (DE) ..... 10 2021 107 140.2

(51) Int. Cl.
*E04G 21/04* (2006.01)

(52) U.S. Cl.
CPC ..... *E04G 21/0463* (2013.01); *E04G 21/0436* (2013.01)

(58) Field of Classification Search
CPC .. E04G 21/04; E04G 31/0436; E04G 21/0463
(Continued)

(56) References Cited

U.S. PATENT DOCUMENTS 5,557,526 A 9/1996 Anderson
6,202,013 B1 3/2001 Anderson et al.
(Continued)

FOREIGN PATENT DOCUMENTS

CN 101845892 B 10/2011
DE 102011075310 A1 11/2012
(Continued)

OTHER PUBLICATIONS

German Office Action for Application No. 10 2021 107 140.2; Dated Dec. 23, 2021; 7 pgs.
(Continued)

*Primary Examiner* — Andrew Joseph Rudy
(74) *Attorney, Agent, or Firm* — Alix, Yale & Ristas, LLP

(57) ABSTRACT

The invention relates to, inter alia, a thick matter conveying system (10) comprising a thick matter pump (16) for conveying a thick matter; a thick matter distributing mast (18) for distributing the thick matter to be conveyed, said thick matter distributing mast (18) having a rotary mechanism (19) which can be rotated about a vertical axis and a mast assembly (40) comprising at least two mast arms (41); a substructure (30) on which the thick matter distributing mast (18) and the thick matter pump (16) are arranged, said substructure (30) comprising a support structure (31) for supporting the substructure (30) by means of at least one horizontally and/or vertically movable support leg (32); a sensor unit (11) comprising at least one sensor for detecting a piece of operating information; and a processing unit (12) for determining a stability parameter of the thick matter conveying system (10) on the basis of the at least one detected piece of operating information and for ascertaining an intended operation of the sensor of the sensor unit (11), said sensor detecting the at least one piece of operating
(Continued)

information. If the processing unit (12) does not ascertain an intended operation of the sensor, the processing unit (12) is designed to determine the stability parameter on the basis of an extreme value of the operating information to be detected by the sensor instead of the detected piece of operating information.

18 Claims, 4 Drawing Sheets

(58) Field of Classification Search
USPC ..... 701/50; 700/282
See application file for complete search history.

(56) References Cited

U.S. PATENT DOCUMENTS

| | | | | |
|---|---|---|---|---|
| 7,729,832 | B2 * | 6/2010 | Benckert | E04G 21/0463 222/533 |
| 8,727,379 | B2 * | 5/2014 | Goeggelmann | B66C 23/80 280/763.1 |
| 11,655,642 | B2 * | 5/2023 | Bertram | E04G 21/0463 701/50 |
| 12,024,906 | B2 * | 7/2024 | Müller | E04G 21/0445 |
| 12,215,509 | B2 * | 2/2025 | Wiesenack | E04G 21/0463 |
| 2004/0076505 | A1 * | 4/2004 | Kinnard | H01L 21/67748 414/744.2 |
| 2004/0119597 | A1 | 6/2004 | Petzold et al. | |
| 2014/0015685 | A1 | 1/2014 | Wei et al. | |
| 2020/0392746 | A1 | 12/2020 | Bertram et al. | |
| 2020/0392747 | A1 | 12/2020 | Henikl et al. | |
| 2021/0010281 | A1 | 1/2021 | Müller | |
| 2023/0151624 | A1 * | 5/2023 | Troyer | E04G 21/0445 222/533 |
| 2024/0295132 | A1 * | 9/2024 | Müller | F04B 15/023 |

FOREIGN PATENT DOCUMENTS

| | | | |
|---|---|---|---|
| DE | 1020144013737 | A1 | 11/2015 |
| DE | 102015114166 | A1 | 3/2017 |
| DE | 102016125145 | A1 | 6/2018 |
| DE | 102018204079 | A1 | 9/2019 |
| DE | 102019105817 | A1 | 9/2020 |
| DE | 1020211107140 | A1 | 9/2022 |
| EP | 1356910 | A1 | 10/2003 |
| EP | 1659235 | A1 | 5/2006 |
| EP | 1366253 | B1 | 9/2006 |
| EP | 1849931 | A2 | 10/2007 |
| EP | 2555067 | A1 | 2/2013 |
| EP | 4314441 | B1 | 8/2024 |
| JP | 2004526082 | A | 8/2004 |
| JP | 2013523558 | A | 6/2013 |
| KR | 20200012090 | A | 2/2020 |
| WO | 2019175400 | A1 | 9/2019 |
| WO | 2022200253 | A1 | 9/2022 |

OTHER PUBLICATIONS

PCT International Search Report and Written Opinion for International Application No. PCT/EP2022/057308 filed on Mar. 21, 2022; Date of Mailing: Jun. 24, 2022; 12 pgs.

Japanese Examination Report for Patent Application No. 2023558214, Dispatch Date: Jul. 15, 2005, 8pgs.

European Patent Office Communication, Notice of Opposition for Application No./Patent No. 22714874.9-1005 / 4314441, Dated: May 26, 2025, 2 pgs.

Notice of Opposition to a European patent, Patent opposed—European patent No. EP4314441, European application No. EP22714874.9, Date of mention of the grant in European Patent Bulletin (Art. 97 (3), Art. 99(1) EPC), Title: "Fail-Safe Stability Montoring Function for a Thick Matter Conveying System", Proprietor of the patent—Putzmeister Engineering GmbH, Oppenent—CIFA SpA. EPO Form 2300E-R7-9770, 21 pgs.

Notice of Opposition to a European patent, Contested patent—European Patent No. EP414441, European Application No. EP22714874.9, Date of mention of the grant in the European Patent Bulletin (Art. 97 (3), Art.99(1) EPC), Title: "Fail-Safe Stability Monitoring for a Thick Material Conveying System", Patent Holder—Putzmeister Engineering GmbH, Opponent—Schwing GmbH, EPA Form 2300E-SHWIG1324, 80 pgs.

Evidence—(CIFA SpA/D6)—CIFA, A Zoomlion Company, Sale of a Concrete Pump, Proforma Invoice No. 16 dated Nov. 3, 2019, 1 pg.

Evidence—(CIFA SpA/D6.1)—CIFA, A Zoomlion Company, Sale invoice dated Mar. 29, 2019, 1pg.

Evidence—(CIFA SpA/D6.2)—(Manufacturer: CIFA Spa, Picture of Serial No. 20831, Title: "Concrete Pump With Placing Boom", 1 pg.

Evidence—(CIFA SpA/D6.3)—CIFA, EC Declaration of Conformity dated Mar. 13, 2019, 1 pg.

Evidence—(CIFA SpA/D6.7)—Picture of a first sensor disconnected, 1pg.

Evidence—(CIFA SpA/D6.8)—Picture of a second sensor disconnected, 1pg.

Evidence—(CIFA SpA/D6.9a)—Document related to the exhibition of the machine at Bauma, CMR, N. 162419/20893, 2 pgs.

Evidence—(CIFA SpA/D6.9b)—Delivery note related to the shipment of said machine to Bauma, CIFA, N. 15893, DEL Feb. 4, 2019, 1 pg.

Evidence—(CIFA SpA/D7)—Paper from a course of CIFA Academy, CIFA Academy, "Training ACS System", 38 pgs.

Evidence—(CIFA SpA/D7.1)—Metadata related to the creation date of D7—Paper from a course of CIFA Academy, CIFA Academy, "Training ACS System", (E) ASC AdvanceStabilityControl, Title: "Presentazione standard di PowePoint", Author: Antonello Pizzi, Creation date: Jan. 25, 2021, Powered by xmp, 1 pg.

Evidence—(CIFA SpA/D7.2a)—Declaration in Lieu of a Deed of Notoriety (Art. 47 of the Presidential Decree n. 445 of Dec. 28, 2000) by Mr. Paolo Dario Maini of CIFA (Opponent) signed on May 19, 2025, 1pg.

Evidence—(CIFA SpA/D7.2b)—Declaration in Lieu of a Deed of Notoriety (Art. 47 of the Presidential Decree n. 445 of Dec. 28, 2000) by Mr. Stefano Ferri of CIFA (Opponent) signed on May 19, 2025, 1pg.

Evidence—(CIFA SpA/D7.2c)—Declaration in Lieu of a Deed of Notoriety (Art. 47 of the Presidential Decree n. 445 of Dec. 28, 2000) by Mr. Massimo Calculli of CIFA (Opponent) signed on May 19, 2025, 1pg.

Evidence—(Schwing/A14)—DIN EN ISO 13849-1 in excerpts, adopted as a European standard ISO standard, German Standard, Jun. 2016, 18 pgs.

* cited by examiner

FAIL-SAFE STABILITY MONITORING FUNCTION FOR A THICK MATTER CONVEYING SYSTEM

BACKGROUND

The present invention relates, among other things, to a thick matter conveying system having a thick matter pump, a thick matter distributor mast, a substructure, a sensor unit and a processing unit, as well as to a method for operating a thick matter conveying system.

Known from the prior art are generic thick matter or slurry conveying systems. For the stability monitoring of the latter, various operating parameters are observed, so that when a critical value of such an operating parameter is exceeded, the thick matter conveying system in response thereto can be actuated in a defined manner and typically an orderly overall operation of the thick matter conveying system is discontinued. It is problematic when an observation of an operating parameter required for stability monitoring is not possible or possible only in an unreliable manner, for example in the event of a defect in the sensor of the operating parameter to be captured.

SUMMARY

Against the background of the issues mentioned above, it is an object of the present invention to provide an improved thick matter conveying system and an improved method for operating a thick matter conveying system.

The achievement according to the invention lies in the features of the independent claims. Advantageous refinements are the subject matter of the dependent claims.

Disclosed according to the invention is a thick matter or slurry conveying system, having a thick matter or slurry pump for conveying a thick matter; a thick matter distributor mast for distributing the thick matter to be conveyed, wherein the thick matter distributor mast has a slewing gear which is rotatable about a vertical axis, and a mast assembly comprising at least two mast arms; a substructure on which are disposed the thick matter distributor mast and the thick matter pump, wherein the substructure comprises a support structure for supporting the substructure by way of at least one horizontally and/or vertically displaceable support leg; a sensor unit with at least one sensor for capturing an item of operational information; and a processing unit for determining a stability parameter of the thick matter conveying system depending on the at least one captured item of operational information, and for establishing an orderly operation of the sensor of the sensor unit, that captures the at least one item of operational information, wherein, if the processing unit does not establish an orderly operation of the sensor, the processing unit is specified to determine the stability parameter depending on an extreme value of the item of operational information to be captured by the sensor instead of the acquired item of operational information.

The thick matter conveying system according to the invention is, for example, a truck-mounted concrete pump.

The invention relates to a particularly advantageous design embodiment of a thick matter conveying system, in which for determining the stability by way of a stability parameter it is additionally established and thus verified whether the item of operational information to be taken into account in this event also emanates from a sensor operated in an orderly manner. If it is determined that the sensor that captures the item of operational information is in fact not in orderly operation, an extreme value of the item of operational information that is actually to be captured by the sensor not in orderly operation shall be taken into account for the purpose of a conservative estimation in the determination, instead of the captured item of operational information, which extreme value represents such a position of a component at which the processing unit would determine the greatest stability parameter and thus the least stability. Thus, for that component of the thick matter conveying system for which the property should be characterized by the operational information to be captured by the sensor not in orderly operation, the influence of said component on stability is assumed to be reductive to the greatest possible extent. The extreme value should therefore characterize a "worst-case" influence of the component on the stability of the thick matter conveying system.

The invention has recognized that by determining whether the sensor capturing the item of operational information is in orderly operation at all, it can be avoided that items of operational information which are provided by faulty sensors and thus are regarded as unreliable can be used in determining the stability. The dependence of the subsequent determination of the stability parameter on an extreme value of the item of operational information to be considered, as required in this case and described above, nevertheless also permits a significant and reliable determination of the stability of the thick matter conveying system to be able to be performed overall, and thus guarantees the most efficient continued operation of the individual components of the thick matter conveying system. In this way, fail-safe stability monitoring can be implemented without the need for redundancy of components, in particular complex sensors. An otherwise usual shutdown of the entire thick matter conveying system for stability reasons can be avoided. A shutdown is generally undesirable, as in this case concrete in the line usually needs to be pumped back, which often results in damage due to the rapid curing of concrete. In addition, access to the site of the concreting work is made more difficult by the shut-down concrete pump. The possibility of avoiding a shutdown is also particularly advantageous for concreting operations that have to be made in one piece, for which a further concrete pump typically has to be made available to protect critical concreting work. A much more efficient operation without unnecessary interruptions is made possible in this way. As a result, too, repairing the sensor that cannot be operated in an orderly manner is not immediately necessary, but can be carried out within the scope of a normal inspection interval, this significantly increasing the potential service life of the thick matter conveying system.

First, some terms are to be explained hereunder:

Thick matter is a generic term for hard-to-convey media. The thick matter can be, for example, a substance with coarse-grained components, a substance with aggressive components, or similar. The thick matter can also be a bulk material. In one embodiment, the thick matter is fresh concrete. Fresh concrete can contain grains up to a size of more than 30 mm, binds, forms deposits in voids, and for these reasons is difficult to convey. Exemplary thick matter are concrete with a density of 800 kg/m$^3$ up to 2300 kg/m$^3$ or heavy concrete with a density of more than 2300 kg/m$^3$.

The thick matter pump can comprise a core pump with two, for example exactly two, conveying cylinders. Switching then takes place in an alternating manner from the first to the second feed cylinder and from the second to the first feed cylinder. An S-pipe can be cyclically switched between the feed cylinders. In addition, an auxiliary cylinder can be specified to bridge each of the transitions.

The S-pipe is a movable section of the pipe by way of which the feed cylinders are alternately connected to the outlet of the thick matter pump. The pipe section and the auxiliary cylinder can be elements of an assembly that is releasably connected to the thick matter pump. This can facilitate maintenance and cleaning of the thick matter pump.

The slewing gear is rotatable about a vertical axis, for example a central axis of the slewing gear, for example by 360 degrees. The slewing gear can comprise at least one actuator, such as a hydraulic or pneumatic cylinder, or an electromechanical actuator, or a combination of a plurality of even different types of actuators, by way of which said slewing gear can rotationally change its position in relation to the substructure. To this end, the slewing gear typically comprises a hydraulic motor and a pinion with planetary gearbox.

The mast assembly comprises at least two mast arms, but can also comprise three, four or five mast arms. Typically, the mast assembly comprises three to seven mast arms. The first mast arm at its proximal end is connected to the slewing gear, and at its distal end is connected to the proximal end of an adjacent mast arm. The other mast arm(s) is/are in succession and at its/their proximal end respectively connected to a distal end of the adjacent mast arm. The distal end of the mast assembly corresponds to the distal end of the last-in-succession mast arm which at its distal end also has no further connection. The distal end of the last-in-succession mast arm defines a possible load attachment point.

The mast arms are each connected to one another by way of a mast joint in such a way that they can be moved at least, for example exclusively, in one dimension at least independently of the other mast arms. Each mast arm at its proximal end is assigned the mast joint.

The first mast arm by way of its mast joint is connected to the slewing gear in such a manner that, if the slewing gear rotates about its vertical axis, the first mast arm, and in embodiments the entire mast assembly, is also rotated about this axis. For example, the mast arm is fastened to the slewing gear in such a way that said mast arm can be moved, for example exclusively, in a vertical direction independently of the slewing gear and can be rotated by way of its mast joint, for example. It is also conceivable that a mast arm has a telescopic functionality and can be telescopically and continuously extended or shortened along its longitudinal axis. For example, a mast arm is adjustable such that at least the distal end of the mast arm can be moved at least in one of the three spatial directions (x, y and z directions).

Alternatively or additionally, a mast arm can be rotatable about its longitudinal axis. For example, a mast arm for its mast joint comprises at least one actuator, such as a hydraulic or pneumatic cylinder, or an electromechanical actuator, or a combination of a plurality of even different types of actuators, by way of which said mast arm can change its position relative to at least another mast arm, in particular the mast arm connected to the proximal end. The actuators can be specified, for example, to rotationally pivot the mast arm about a horizontal axis, the latter for example running through its mast arm joint, and/or to move said mast arm in a translatory manner in one, in two, or in all spatial directions.

Alternatively or additionally, the mast arm can have further actuators by means of which it can be extended, shortened or rotated, for example telescopically.

The substructure is a basic structure, for example a chassis, on which the thick matter distributor mast and the thick matter pump are disposed. For example, the thick matter distributor mast and/or the thick matter pump are fastened to the substructure. The substructure can be configured to be stationary (for example as a platform), or mobile (for example as a vehicle). As a result of the thick matter distributor mast and the thick matter pump being disposed on the substructure, the entire thick matter conveying system can be configured to be particularly compact as a unit, and for example in the form of a truck-mounted concrete pump.

The substructure comprises a support structure for supporting the substructure by way of at least one support leg that is displaceable horizontally and/or vertically. A support leg of a thick matter conveying system is a component of the support structure that serves to increase the stability of the thick matter conveying system. The influence of the support structure on the stability depends in particular on an individual arrangement and set-up of support legs. To this end, the support leg can be supported on the ground by way of a support plate. Four support legs are typically provided in a support structure.

The thick matter conveying system comprises means for carrying out or controlling the method according to the invention. These means comprise in particular the sensor unit and the processing unit, but can also comprise a control unit of the thick matter conveying system, and can respectively be configured as separate hardware and/or software components or as hardware and/or software components integrated in different combinations. The means comprise, for example, at least one memory with program instructions of a computer program and at least one processor, the latter being configured to execute program instructions from the at least one memory.

The sensor unit is specified to capture at least one item of operational information, in particular automatically and independently of a user input. It is conceivable that an item of operational information is captured repeatedly at defined temporal intervals. For example, the capturing of an item of operational information can take place by measuring a measurement variable characteristic of this item of operational information. To this end, the sensor unit can comprise one or a plurality of sensors of the same type or of different types. Exemplary sensors include angle sensors (e.g. for capturing a position of the slewing gear), force and pressure sensors (e.g. for capturing a cylinder force of a mast joint, a force acting on an actuator of a mast arm or a leg force of a support leg), position sensors (e.g. sensors of a satellite-based position system such as GPS, GLONASS or Galileo) for capturing the position of a mast arm or the position of a support leg, position sensors (e.g. spirit levels or inclination sensors for capturing an inclination angle of a mast arm), electrical (e.g. induction sensors), optical sensors (e.g. light barriers, laser sensors or 2D scanners) or acoustic sensors (e.g. ultrasonic or vibration sensors). Similarly, an item of operational information can also be captured by the interaction of a plurality of sensors of the sensor unit.

Alternatively or additionally, the sensor unit can also comprise one or a plurality of (e.g. wireless) means of communication, by way of which (e.g. externally) captured or defined items of operational information can be received at the sensor unit.

The processing unit should be understood as being specified to determine a stability parameter of the thick matter conveying system. This is to be based on at least one, in particular all, captured items of operational information. For example, said processing unit can have access to the information collected by the sensor unit. The determination of the stability parameter is also to be understood to include that the stability parameter is calculated by reference to defined properties of components of the thick matter conveying system that are assumed to be constant, such as their mass or their spatial expansion.

An orderly operation of a component is to be understood to mean such an operation as is intended for the component in principle and in industrial practice, and for which the component is designed under typically prevailing conditions. For example, a specific power supply to the component is provided during the orderly operation of a component.

It is provided that the processing unit is specified for establishing an orderly operation of a sensor of the sensor unit that captures at least one item of operational information. The processing unit here is to verify that the sensor is operating in an orderly manner. Measures for establishing an orderly operation are known to the person skilled in the art. For example, to this end the processing unit verifies a plurality of criteria that rule out an orderly operation. For instance, a sensor can comprise two measuring systems, the captured values of which are compared with one another to capture the item of operational information. Alternatively or additionally, the processing unit can also carry out plausibility checks during which the processing unit establishes whether an item of operational information captured by a sensor is physically meaningful. The processing unit can also verify the power supply of the sensor, for example, and rule out an orderly operation in the event of unusual variances. It is also conceivable that an item of operational information is captured twice in direct succession, and the processing unit in the event of a variance of a measured value for which the respective captured item of operational information is indicative rules out an orderly operation above a definable maximum permissible variance.

The stability of the thick matter conveying system is increased the greater the spacing of the line of action, which takes into account all the forces acting on the thick matter conveying system, from the tilting edges of the contact surface. However, a reliable statement pertaining to stability can already be made on the basis of a line of action that at least takes into account the weight force acting on the thick matter conveying system. The more of the forces actually acting in the line of action are taken into account, the more precise this statement can be made. Therefore, the stability of the thick matter conveying system can be characterized particularly advantageously by a stability parameter representing the spacing of the line of action from the tilting edges of the contact surface. The stability parameter is located within a defined or dynamically determinable stability range, within which the spacing of the line of action from each of the tilting edges is greater than or equal to zero; in this instance a safety margin is preferably also taken into account. The stability of the thick matter conveying system is provided within the stability range. The upper limit of the stability range is defined by a maximum stability parameter. The maximum stability parameter is present when the spacing of the line of action from one of the tilting edges is zero. Accordingly, the spacing of the line of action from at least one of the tilting edges decreases as the stability parameter increases. Above the upper limit, the spacing is less than zero and the stability of the thick matter conveying system is no longer provided. It is conceivable that a stability range is defined or determinable for each operating situation of the thick matter conveying system, for example taking into account properties that are assumed to be constant of the components of the thick matter conveying system that are to be taken into account. For example, for each possible arrangement of the support structure, for example, by way of a specific set-up of support legs, a contact surface can be defined or determinable for this purpose.

The spacing of the line of action from one of the tilting edges and the orientation of the line of action are at least each dependent on the weight force of the thick matter conveying system and can be calculated by the processing unit, for example. The orientation of the line of action can have vertical and horizontal direction components, and can depend on one or a plurality of directions of action and/or values of additional forces. For example, one or a plurality of forces to be taken into account can be defined or selectable by a user (e.g. by means of a suitable user interface). If, for example, only the weight force of a thick matter conveying system is taken into account, then the line of action corresponds to a plumb line running through the overall center of gravity. The orientation of the line of action in this instance is identical to the position of the plumb line. If the orientation of the line of action additionally depends on a force having a horizontal component, such as a wind force acting on the side of the thick matter conveying system, then the orientation of the line of action also includes at least one horizontal component, and its position is not identical to that of the plumb line. It is conceivable that the orientation of the line of action is dependent on one or more additional forces in such a way that the processing unit, preferably only, upon the occurrence of one or more specific conditions, for example above a wind force prevalent in the operation of the thick matter conveying system, is able to adapt the position gradually, for example by a respective defined amount in a defined direction. It is also conceivable that the orientation of the line of action depends on the directions of action and/or amounts of one or a plurality of, preferably all, items of operational information captured by the sensor unit and indicative for forces.

An item of operational information is indicative of a property or an operational parameter of a multiplicity of possible properties and operational parameters of a component of the thick matter conveying system and representative of that property or operational parameter. It should therefore be possible to assign an item of operational information to a component. Such a property or an operating parameter can be characterized, for example, by a measurement variable. These can be properties and operational parameters that come to light before or after the start of the conveying process.

Instead of the captured item of operational information, possibly an extreme value of the item of operational information to be captured by the sensor should be taken into account when determining the stability parameter. This extreme value is to be understood to mean such an, in particular hypothetical, item of operational information which the sensor would capture at a position of an associated component at which the processing unit determines the greatest stability parameter and thus the least stability. The extreme value can be a minimum value or a maximum value. The extreme value of an item of operational information can also depend on one or a plurality of other items of operational information. For example, there can be a plurality of extreme values for an item of operational information, wherein the extreme value to be taken into account is in particular dependent on a momentary value of a further item of operational information. For example, such an extreme value is stored in the processing unit for each sensor of the sensor unit.

In one embodiment, the thick matter conveying system comprises a communication interface and/or a first user interface, the communication interface and the user interface being respectively specified to capture the extreme value or an extreme value range of the item of operational information to be captured by the sensor.

Such a communication interface can comprise one or a plurality of (e.g. wireless) communication means by way of which externally captured extreme values entered by a user at a user terminal, for example, are received by the thick matter conveying system in a way known to a person skilled in the art. It can also be provided that an extreme value range is captured. In this case, the processing unit can select an extreme value to determine the stability parameter from the captured extreme value range, for example by way of defined selection rules. For example, if a plurality of possible extreme values for the item of operational information to be captured are present, the processing unit can select an extreme value, in particular depending on one or a plurality of other items of operational information.

If a user interface is provided for capturing the extreme value of the item of operational information to be captured by the sensor, this user interface can be configured as at least one button, a keypad, a keyboard, a mouse, a display unit (e.g. a display), a microphone, a touch-sensitive display unit (e.g. a touch screen), a camera and/or a touch-sensitive surface (e.g. a touchpad). For example, the capturing of the extreme value takes place by capturing a user input at the user interface.

This represents further options in terms of how the processing unit can obtain access to the extreme value it optionally needs to take into account.

Additionally, the thick matter conveying system can have at least a second user interface for indicating a momentary value of the item of operational information to be captured by the sensor, wherein the communication interface or the first user interface is specified to capture the momentary value of the item of operational information to be captured by the sensor, and wherein the processing unit is specified to determine the stability parameter depending on the momentary value of the item of operational information to be captured by the sensor.

The momentary value should be understood to mean such an item of operational information that the sensor would capture if it assumed an orderly operation at the time of measurement. Such a momentary value can, for example, correspond to a currently present measured value or measured value range of which the user information to be captured by the sensor is indicative. For example, the momentary value of the item of operational information to be captured by the sensor can be indicated by means of a second user interface associated with the sensor.

By means of a second user interface, a user is to be able to access a momentary value independently of the sensor and, for example, to read it. Accordingly, the second user interface can be embodied as a display. For example, the thick matter conveying system has one or a plurality of second user interfaces in the form of scales which are disposed on components and respectively represent a momentary value. The user can then read the momentary value. The momentary value can then be made available to the processing unit by way of the communication interface or the first user interface, for example by means of an appropriate user input. The processing unit then takes the momentary value into account when determining the stability.

This can be done, for example, in the form that if the processing unit has not captured an orderly operation of the sensor, the stability parameter is determined depending on the momentary value instead of the extreme value if the momentary value is less than a maximum extreme value or greater than a minimum extreme value.

By way of example, the sensor unit comprises at least one position sensor for capturing an item of operational information which is indicative of a position of one of the mast arms.

This can be an absolute position, i.e. position and/or orientation, or else a relative position of the mast arm. A position can be captured, by way of example, in the form of an inclination angle of the mast arm relative to the plumb direction by means of an inclination sensor. A relative position can be characterized by the position of a mast arm in comparison to another mast arm connected to the proximal end of the mast arm. In the case of the first mast arm connected to the slewing gear, this can be the position relative to the vertical axis of the slewing gear. Because the dimensions of the mast arm and the positions of the mast arm or the slewing gear to be set in relation, respectively, are known, the position of a mast arm can already be unequivocally determined by capturing the relative position, for example the inclination angle.

Preferably, both the slewing gear and a first mast arm of the mast assembly as well as two of the mast arms are respectively connected by way of an articulated joint, wherein the position of a mast arm is continuously detectable, in particular by determining the opening angle of the mast arm. For example, the opening angle can be ascertained by comparing the inclination angles of the mast arms connected by way of the articulated joint. Moreover, the control unit can be specified to limit the operating range of the mast assembly to the currently permissible opening angle by restricting the pivoting capability of the mast arm. In addition, it is conceivable that all articulated joints have mutually parallel articulated axes. Further, the articulated joints can respectively have a maximum opening angle of 120 degrees, preferably of 150 degrees, and particularly preferably of 180 degrees. However, opening angles between 180 degrees and 235 degrees, up to 270 degrees, or up to 360 degrees, are also conceivable.

This is a particularly easy-to-implement and functional design of the connection between the mast arms or between the mast arm and the slewing gear, in which a large scope of actions for the thick matter distributor mast is still maintained. Moreover, in such an embodiment, the sensor unit can capture the position of a mast arm particularly easily by determining the corresponding inclination angles. The use of complex and comprehensive sensor systems for capturing the position of the mast arm can be avoided.

Preferably, the sensor unit comprises at least one leg position sensor for capturing an item of operational information that is indicative of a position of the support leg.

With the aid of the set-up of support legs, the contact surface can be increased particularly easily and the stability range can be increased in terms of at least one tilting edge. Therefore, the position of the at least one support leg is of particular significance for the determination of the stability parameter. In particular, the horizontal spacing of the contact surface and the direction of the horizontal distance of the support leg in the respective operating state in comparison to a zero position in the retracted state are determined. Additionally, the vertical spacing can also be determined and taken into account. It is also conceivable that the leg position sensor is embodied as a GPS sensor.

According to one embodiment, the sensor unit comprises at least one angle sensor for capturing an item of operational information, which is indicative of a position of the slewing gear.

The consideration of this property serves to allow an asymmetrical orientation of the support structure or an operation on inclined ground, and thus an asymmetry of the contact surface, to be included in the determination of the stability parameter.

Preferably, the sensor unit comprises at least one position sensor for capturing an item of operational information which is indicative of an inclination angle of the thick matter conveying system.

The inclination angle should be an angle of the thick matter conveying system relative to the plumb direction. A maximum permissible inclination angle can be specified for the thick matter conveying system. If the thick matter conveying system is operated on an inclined plane, i.e. when tilted, the profile of the line of action that takes into account at least the weight force acting on the thick matter conveying system, and thus the spacing of the line of action from the tilting edges, can change. Therefore, the inclusion of an inclination angle of the thick matter conveying system is particularly significant when determining the stability parameter.

Advantageously, the sensor unit comprises at least one distance sensor for capturing an item of operational information which is indicative of an extension of the thick matter conveying system.

An extension occurs when the thick matter conveying system is supported by its support structure, for example the support legs of the support structure. Moreover, the extension under consideration can be further characterized, for example on the basis of its height. This can be defined, for example, by the size of a vertical spacing of the contact surface of the support leg relative to a, for example, definable, zero position. Alternatively or additionally, a vertical spacing of another component of the thick matter conveying system, such as the substructure, can be utilized. Likewise, an extension can also be established by exceeding a defined threshold of a captured vertical leg force. If the thick matter conveying system is configured as a truck-mounted concrete pump, the extension can also be characterized by measuring the spring travel of the vehicle axles. The presence of an extension has an effect on the position of the overall center of gravity and thus on the stability of the thick matter conveying system. By capturing the extension, it can be ensured above all that mass components of the thick matter conveying system to be considered are not suspended on the ground and, if applicable, cannot be taken into account as a counterweight. The consideration of the extension in the determination of the stability parameter therefore permits an even more precise determination of the stability.

Optionally, the sensor unit comprises at least one leg force sensor for capturing an item of operational information which is indicative of a horizontal or vertical leg force of the support leg. Further, the sensor unit can comprise at least one sensor for capturing an item of operational information which is indicative of a load torque of one, a plurality of, or all, mast arms.

A horizontal or vertical leg force is to be understood to mean a horizontal or vertical force acting on a support leg. For example, indicative of a load torque of a mast arm is its joint torque. The joint torque of a mast arm is the moment acting on its mast joint. This represents a moment that depends, inter alia, on the total weight of the mast assembly, on wind loads, on the weight of the thick matter to be conveyed or also on the weight acting at the distal end of the first mast arm of the mast assembly, corresponding to a mast peak load. A conclusion pertaining to the joint torque can be drawn, for example, by measuring a cylinder force acting in the actuator of the mast arm or a cylinder pressure acting in the actuator of the mast arm in conjunction with one or a plurality of other measurements, such as a measurement of the respective joint angle. For example, the joint torque of a mast arm can be calculated by means of a transmission function from a cylinder force and an articulation angle of the mast joint of the respective mast arm. The stability parameter of the thick matter conveying system can be reliably determined by way of these properties. This, in turn, makes it possible to make a reliable statement pertaining to the stability of the thick matter conveying system.

In addition, the processing unit can be specified to calculate a load torque based on items of operational information captured that are indicative of the joint torques of all mast arms, and to determine the stability parameter depending on the calculated load torque. In this way, the processing unit can, for example, make a particularly precise determination of the stability parameter in real time, taking into account the cylinder pressure and the inclination angle of the respective mast arms. Nevertheless, the sensor unit in this instance must be specified to capture items of operational information indicative of the cylinder force and the inclination angles of all mast arms, and for example include a plurality of sensors suitable for this purpose.

Further, the sensor unit can comprise a cylinder pressure sensor and/or a cylinder force sensor on a bottom side and/or on a rod side of an A-cylinder of the mast assembly.

An A-cylinder is to be understood to be an actuator of the first mast arm, the pressure chamber thereof used to deploy the cylinder being the bottom side, and the facing pressure chamber thereof used to retract the cylinder being the rod side. By means of one or a plurality of such sensors, an item of operational information indicative of a cylinder force of one, a plurality of, or all, mast arms can be captured particularly easily. This enables a calculation of the load torque, by way of which the stability parameter is particularly easy to determine.

Further exemplary items of operational information are indicative of weights of all mast arms with a filled and/or unfilled conveyor line, of positions of the center of gravity of all mast arms, of weights of additional loads, of positions of additional weight attachment points, of wind forces acting on the mast arms, of positions of the wind center of gravity of all mast arms, of the weight of the substructure, of a position of the center of gravity of the substructure, and of positions of the contact surfaces of the support legs in the retracted and/or extended state.

Preferably, the thick matter conveying system comprises a control unit for emitting a first control signal if the determined stability parameter of the thick matter conveying system is greater than a maximum stability parameter of the thick matter conveying system, and for emitting a second control signal if the determined stability parameter of the thick matter conveying system is less than or equal to the maximum stability parameter of the thick matter conveying system. Alternatively or additionally, emitting further control signals can be provided by the control unit, for example, if a predetermined minimum spacing between the determined stability parameter and the maximum stability parameter is not reached.

The control unit comprises corresponding means to emit control signals, such as a wired or wireless signal output, for example. By emitting control signals in the manner described, the control unit can actuate at least one component of the thick matter conveying system, and act on an operating parameter of the component. It is conceivable that while emitting the second control signal causes the orderly operation to continue, emitting the first control signal, on the other hand, causes a discontinuation of the orderly operation of the thick matter conveying system. Emitting the further control signals can, for example, cause the operation of one or a plurality of components of the thick matter conveying system to take place at a reduced speed in comparison to the orderly operation.

For example, the control unit can be specified to limit an operating range of the mast assembly to a currently permissible operating range, if the determined stability parameter of the thick matter conveying system is greater than the maximum stability parameter, to which end the control unit comprises corresponding means.

Limiting an operating range of one or a plurality of components of the thick matter conveying system is to be understood to mean limiting an operating parameter of the respective component and causing the component to operate according to the limited operating parameter. This means that the respective operating parameter can be limited to a still permissible scope of action, or a still permissible intensity of action of the component, depending on the determined stability parameter. The operation of the component outside the permissible operating range is precluded in particular. Upon limiting, the scope of action or the intensity of action is smaller than the respective maximum scope of action provided for the component in principle, for example during orderly operation, and the maximum action intensity provided in principle. For example, the control unit can determine a currently permissible upper limit for the operating range of the mast assembly, and the operation of the thick matter conveying system can be effected in such a manner that the mast assembly is deflected only below the determined upper limit. Accordingly, it can then be prevented, for example, that the opening angle or the actuator force of a mast arm of the mast assembly exceeds a correspondingly determined limit. To this end, the respective actuator can, for example, receive a suitable control signal, which is emitted by the control unit. For example, the control unit can thus limit the deflection of a mast arm by an actuator. Moreover, limiting the operating range of the mast assembly should also be understood as an additional or alternative limiting of the rotation angle range of the slewing gear.

Moreover disclosed according to the invention is a method for operating a thick matter conveying system, having a thick matter pump for conveying a thick matter, a thick matter distributor mast for distributing the thick matter to be conveyed, wherein the thick matter distributor mast has a slewing gear which is rotatable about a vertical axis, and a mast assembly comprising at least two mast arms, a substructure on which are disposed the thick matter distributor mast and the thick matter pump, wherein the substructure comprises a support structure for supporting the substructure by way of at least one horizontally and/or vertically displaceable support leg, and having a sensor unit with at least one sensor for capturing an item of operational information, and having a processing unit, the method comprising the steps: capturing at least one item of operational information; establishing, by the processing unit, an orderly operation of the sensor of the sensor unit that captures the at least one item of operational information; if an orderly operation of the sensor is not captured, determining, by the processing unit, a stability parameter of the thick matter conveying system depending on an extreme value of the operational information to be captured by the sensor instead of the captured item of operational information; and, otherwise, determining, by the processing unit, the stability parameter depending on the at least one captured item of operational information.

In one embodiment, the method further comprises the steps: emitting, by a control unit of the thick matter conveying system, a first control signal if the determined stability parameter of the thick matter conveying system is greater than a maximum stability parameter of the thick matter conveying system; and emitting, by the control unit, a second control signal if the determined stability parameter of the thick matter conveying system is less than or equal to the maximum stability parameter of the thick matter conveying system.

Additionally, emitting the first control signal can comprise: limiting the operating range of the mast assembly to a currently permissible operating range.

For further explanation pertaining to further advantageous developments of the methods, reference is made to the above-described refinements of the thick matter conveying system.

The invention also comprises a computer program with program instructions to cause a processor to carry out and/or control the method according to the invention when the computer program is executed on the processor. The computer program according to the invention is stored, for example, on a computer-readable data carrier.

The embodiments and design embodiments described above are to be understood only as exemplary and are not intended to limit the present invention in any way.

BRIEF DESCRIPTION OF THE DRAWINGS

The invention is explained in more detail hereunder in an exemplary manner with reference to the appended drawings by way of advantageous embodiments.

DETAILED DESCRIPTION

Figure 1:
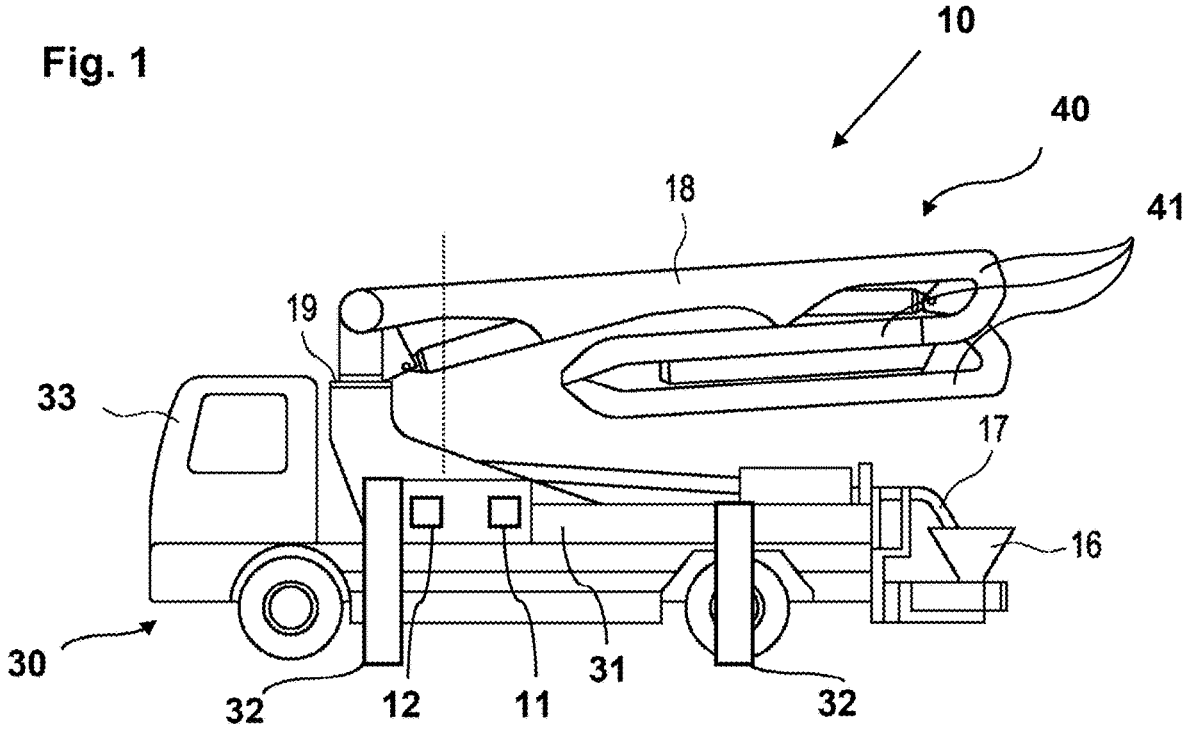
FIG. 1 shows a schematic illustration of an exemplary embodiment of a thick matter conveying system according to the invention in a lateral view.

Shown in FIG. 1 is a thick matter conveying system 10 which comprises a thick matter pump 16 for conveying a thick matter, and a thick matter distributor mast 18 for distributing the thick matter to be conveyed, wherein the thick matter distributor mast 18 has a slewing gear 19, which is rotatable about a vertical axis (shown in dotted lines), and a mast assembly 40 with mast arms 41. Further illustrated is also a conveying line 17 which extends across the mast assembly 40 and is connected to an end of an S-pipe of the thick matter pump 16 disposed on an outlet of the thick matter pump 16.

Moreover, the thick matter conveying system 10 comprises a substructure 30 on which are disposed the thick matter distributor mast 18 and the thick matter pump 16. The substructure 30 has a support structure 31 with four support legs 32 for supporting the substructure 30. The substructure 30 by way of example is shown as disposed on a vehicle 33.

Further provided are a sensor unit 11 and a processing unit 12. The sensor unit 11 is specified to capture an item of operational information by at least one sensor. To this end, for example, said sensor unit 11 can access items of operational information captured by one or a plurality of sensors by way of wired or wireless signal lines.

The processing unit 12 is fundamentally specified to determine a stability parameter of the thick matter conveying system 10, depending on the at least one captured item of operational information. Moreover, the processing unit is also additionally specified to determine an orderly operation of the sensor of the sensor unit 11 that captures the at least one item of operational information. To this end, a corresponding design embodiment of the sensor unit 11 and of the processing unit 12 with the necessary hardware and/or software components is provided for the thick matter conveying system 10. In this way, the processing unit 12 can, for example, verify a sufficient power supply of the sensors of the sensor unit, or access data stored in a memory, for example, stored by the sensors of the sensor unit 11, which comprise items of information about the orderly operation of a sensor. In the present example, the processing unit 12 precludes an orderly operation of the sensor in the event of an insufficient power supply or unusual statistical variances of the items of operational information captured by the sensor. Additionally, the processing unit 12 carries out plausibility checks.

If the processing unit 12 does not establish an orderly operation of the sensor, it determines the stability parameter depending on an extreme value of the item of operational information to be captured by the sensor instead of the captured item of operational information. The extreme value here corresponds to such an item of operational information that the sensor would capture when the component to which the item of operational information to be captured is assigned is at a position at which the processing unit 12 determines the greatest stability parameter and thus the least stability. To this end, extreme values for each sensor of the sensor unit 11 are stored in a memory of the processing unit 12. However, it is also conceivable that the extreme values are captured by way of a communication interface of the thick matter conveying system 10 from a mobile user device, or by way of a user input at a user interface configured as a touch screen of the thick matter conveying system 10, for example in the form of a user dialog. In the process, a user can, for example by means of the mobile user terminal, also request extreme values provided externally, for example online, and render them accessible to the processing unit 12 by way of the communication interface or the user interface.

Alternatively or additionally, it can be provided that an extreme value range of the item of operational information to be captured by the sensor of the sensor unit 11 is captured by the communication interface or the user interface. For this case, the processing unit 12 possesses defined selection rules in order to select an extreme value for determining the stability parameter from the captured extreme value range.

For example, there is a first lower and a second higher extreme value for an item of operational information indicative of the cylinder force on the bottom side of the A-cylinder of the mast assembly 40, wherein one of the two extreme values is to be selected depending on an item of operational information indicative of a wind speed. Thus, in the case of a wind speed above a predetermined threshold, the first extreme value can be selected, and below the predetermined threshold the second extreme value can be selected. In another example, it is to be assumed that the processing unit 12 determines the non-orderly operation of an angle measuring sensor for capturing an item of operational information indicative of the position of the slewing gear (19). As an extreme value, it can then be defined for the position of the slewing gear (19) that any possible rotation between 0° and 360° is assumed for the determination of the stability parameter. Alternatively or additionally, an extreme value range can also be captured, for example by means of user input at a suitable user interface, which is to be utilized for the determination of the stability parameter. In this way, the user can enter, for example, that only an extreme value range between 0° and 180° is to be taken into account for possible positions of the slewing gear (19).

Optionally, the thick matter conveying system 10 has a further user interface in the form of scales disposed on the support legs 32. These scales are respectively assigned to a sensor of the sensor unit 11 that captures an item of operational information indicative of the leg force of a support leg 32, and indicate a momentary value of the item of operational information to be captured by the sensor. It can be provided that a user reads a momentary value, for example when the thick matter conveying system is used in peripheral situations, and renders this momentary value accessible to the processing unit 12, again by way of the first user interface, that is, the touch screen. It is then conceivable that the determination of the stability parameter by the processing unit 12 takes place so as to additionally depend on the momentary value of the item of operational information to be captured by the sensor. For example, the processing unit 12, when the absence of an orderly operation is established by the sensor, can then access both the extreme value and the momentary value and determine the stability parameter, for example depending on a difference of the extreme value and the momentary value.

Further, the processing unit 12 can also access data that comprise items of information pertaining to the respective mass and/or to the respective spatial extent of all components of the thick matter conveying system 10. By way of example, the processing unit 12 can determine the stability parameter of the thick matter conveying system 10 based on a calculation of the current position of the overall center of gravity of the thick matter conveying system 10. For example, to this end the processing unit 12 can calculate the respective spacing of the line of action that takes into account at least the weight force of the thick matter conveying system acting on the overall center of gravity from the tilting edges of the contact surface, and determine the stability parameter depending on the calculated spacing.

Figure 2:
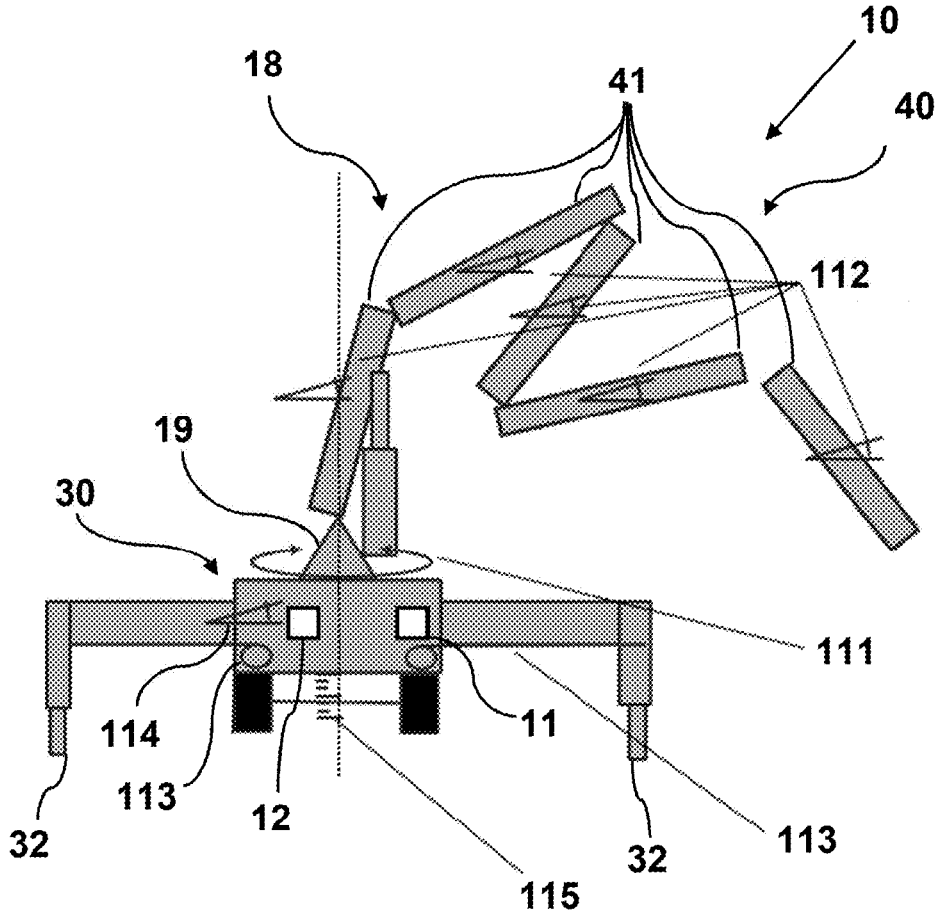
FIG. 2 shows a schematic illustration of an exemplary embodiment of a thick matter conveying system according to the invention in a rear view.
Figure 3:
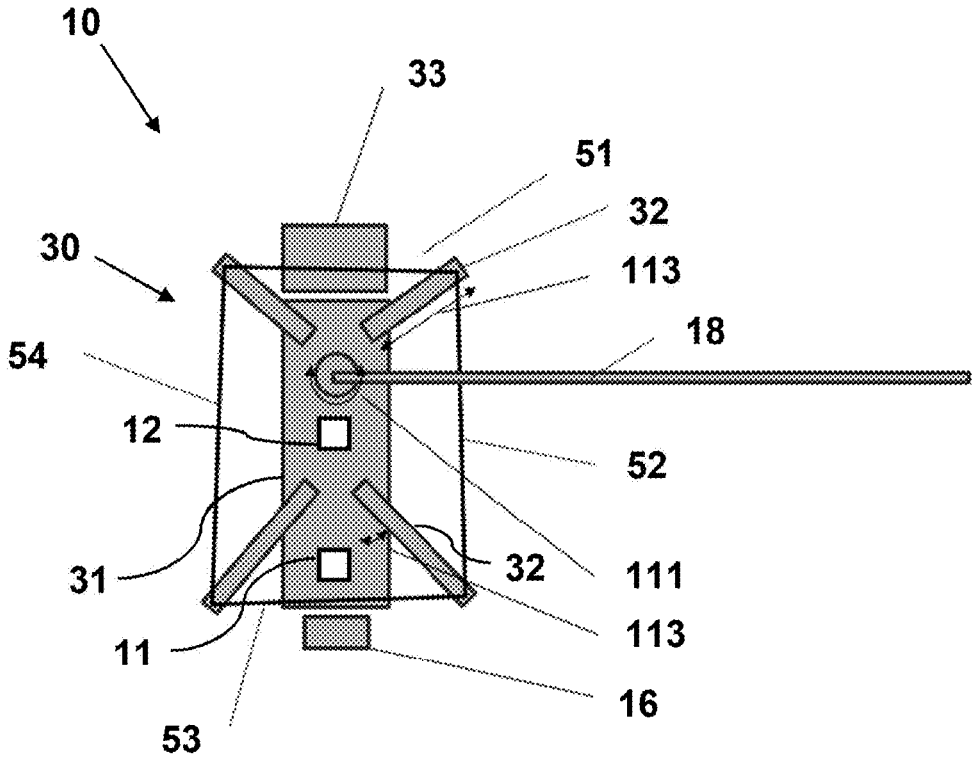
FIG. 3 shows a schematic illustration of an exemplary embodiment of a thick matter conveying system according to the invention in a view from above.

FIGS. 2 and 3 each show an illustration of a thick matter conveying system 10, once in a rear view (FIG. 2), and once in a view from above (FIG. 3). Besides the components already described in FIG. 1, various exemplary sensors of the sensor unit 11 are also shown in exemplary arrangements.

The angle sensor 111 is specified to capture an item of operational information which is indicative of a position of the slewing gear 19. The position to be captured is presently to be a rotation of the slewing gear 19 relative to the substructure 30.

The position sensors 112 are respective sensors that captures an item of operational information which is representative of a position of a mast arm 41 assigned thereto. In the exemplary embodiment shown, the sensors 112 to this end ascertain the positions of the respective mast arm 41 by way of its inclination angle. All position sensors 112 capture items of operational information which are representative of a position of a mast arm 41. Accordingly, these are items of operational information of the same type.

For the respective capturing of an item of operational information which is indicative of a position of a support leg 32, the leg position sensors 113 are provided. In the process, both the horizontal and the vertical spacing of the contact surface of the respective support leg 32 in the current operating state in comparison to its zero position in the retracted state are ascertained. Illustrated by way of example in FIG. 2 is one such leg position sensor 113 and in FIG. 3 two such leg position sensors 113, however, the sensor unit 11 expediently comprises respectively at least one corresponding sensor for each of the support legs 32, so that a plurality of items of operational information of the same type are captured by the sensor unit 11.

The orientation sensor 114, which is configured as an inclination sensor, captures an item of operational information that characterizes an inclination angle of the thick matter conveying system 10 relative to the plumb direction.

The sensor 115 is configured as an optical sensor and specified to capture an item of operational information indicative of an extension of the thick matter conveying system 10. Presently, the extension in an exemplary manner is ascertained by way of the respective vertical spacings of the contact surface of the support legs 32 in relation to their zero position.

The thick matter conveying system 10 shown in FIG. 3 has four tilting edges 51, 52, 53, 54. The tilting edges 51, 52, 53, 54 are defined in particular by the positions of the support legs 32. The greater the spacing of the line of action which takes into account at least the weight force acting on the overall center of gravity of the thick matter conveying system 10 from the tilting edges 51, 52, 53, 54 of the contact surface, the higher its stability. The face delimited by the tilting edges 51, 52, 53, 54 describes the contact surface. If the overall center of gravity approaches the edge of the contact surface, that is to say one of the tilting edges 51, 52, 53, 54, for example in the event of a particularly wide-ranging horizontal deflection of the thick matter distributor mast 18 or when conveying a particularly heavy thick matter through the conveying line 17 extending across the mast assembly 40, the stability of the thick matter conveying system 10 is reduced. If the line of action no longer runs within the contact surface, the spacing of the line of action from one of the tilting edges 51, 52, 53, 54 is less than zero and the stability of the thick matter conveying system is no longer provided.

Figure 4:
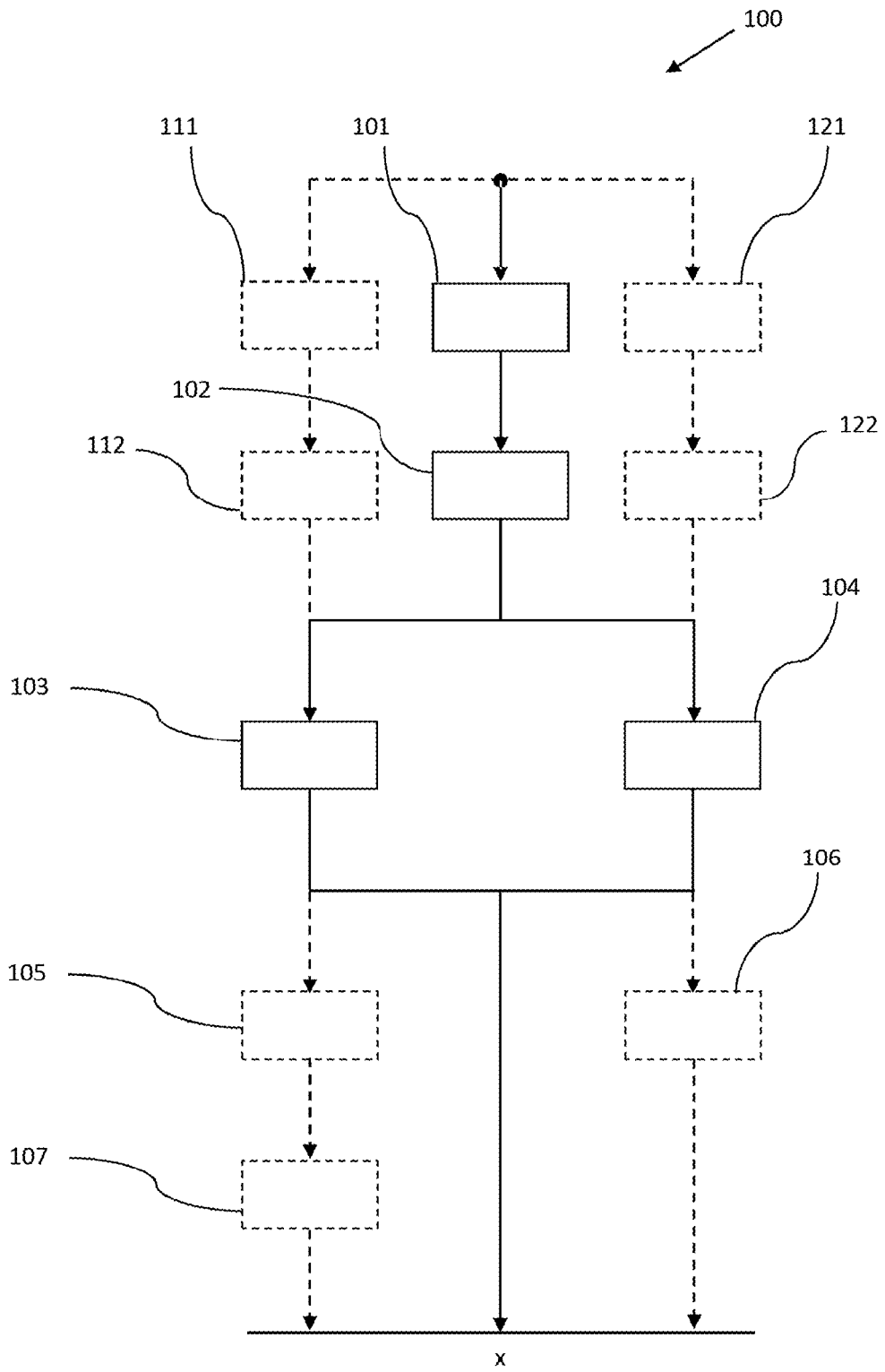
FIG. 4 shows a schematic flow chart of an exemplary embodiment of a method according to the invention.

FIG. 4 shows a flow chart of an exemplary embodiment of a method 100 according to the invention. In a step 101, a sensor of the sensor unit 11 captures an item of operational information of the thick matter conveying system 10. To this end, the sensor measures a measurement variable characteristic of the item of operational information to be captured, for example the inclination angle of a mast arm 41. Accordingly, the sensor is assigned to the mast arm 41. Optionally, a further item of operational information can respectively be captured by a sensor of the sensor unit 11 in the steps 111 and 121. For example, in the steps 111 and 121, the inclination angles of two further mast arms 41 are measured.

In the step 102, the processing unit 12 establishes whether the sensor of the sensor unit 11 that captures the item of operational information in step 101 is in an orderly operation. In the above example, the orderly operation of the sensor that captures the inclination angle is verified. To this end, the processing unit 12 can, for example, verify the power supply of the sensor and determine whether or not said power supply is sufficient. In an analogous manner, the processing unit 12 in the steps 112 and 122 can carry out the same procedure for the respective sensor that captures in the steps 111 and 121.

If an orderly operation of the sensor captured in step 101 is not established by the processing unit 12 in step 102, the processing unit 12 in step 104 determines a stability parameter of the thick matter conveying system 10 depending on an extreme value of the item of operational information to be captured by the sensor instead of the captured item of operational information. In the selected example of the measurement of an inclination angle of a mast arm 41 in step 101, the processing unit 12 then takes into account, for example, a hypothetical item of operational information that is indicative of an inclination angle of 0 degrees for the assigned mast arm 41, that is, a horizontal position of the mast arm 41, since this hypothetical item of operational information corresponds to an item of operational information in which the processing unit 12 determines the largest stability parameter and thus the least stability. To this end, an extreme value is stored in a memory in the processing unit 12 for each sensor of the sensor unit 11. Optionally, if an orderly operation of the respective sensors has not been established in the steps 112 and 122, an analogous procedure can be followed in step 104.

Otherwise, the processing unit 12 in step 103 determines a stability parameter of the thick matter conveying system 10 depending on the items of operational information captured in step 101 and additionally optionally in the steps 111 and 112. For example, this takes place by calculating a current position of the overall center of gravity of the thick matter conveying system 10 based on the captured item of operational information taking into account the mass and the spatial extent of all mast arms 41.

Optionally, this is followed by one of steps 105 and 106.

If the stability parameter of the thick matter conveying system 10 determined by the processing unit 12 is greater than a maximum stability parameter of the thick matter conveying system 10, a control unit of the thick matter conveying system 10 emits a first control signal in step 105. By means of such a control signal, the control unit actuates at least one component of the thick matter conveying system 10 and thus acts on an operating parameter of the component. This can comprise, for example, a further step 107 in the form of limiting the operating range of the thick matter distributor mast 18 to a currently permissible operating range.

In the opposite case, that is, in a determination of the stability parameter of the thick matter conveying system 10 by the processing unit 12 being less than or equal to the maximum stability parameter of the thick matter conveying system 10, the control unit can output a second control signal in a step 106. For example, the control unit can in this way control a thick matter pump 16 in that the pump frequency of the core pump 15 and/or the switching frequency of the S-pipe 24 is increased or reduced.

The embodiments of the present invention described in this specification and the optional features and properties listed respectively in this regard are also to be understood as being disclosed in all combinations with one another. In particular, unless explicitly stated otherwise, the description of a feature comprised by an embodiment is presently also not to be understood in such a way that the feature is indispensable or essential for the functioning of the embodiment.

The invention claimed is:

1. A thick matter conveying system (10), comprising a thick matter pump (16) for conveying thick matter;

a thick matter distributor mast (18) for distributing the thick matter to be conveyed, wherein the thick matter distributor mast (18) comprises a slewing gear (19) which is rotatable about a vertical axis, and a mast assembly (40) comprising at least two mast arms (41);

a substructure (30) on which are disposed the thick matter distributor mast (18) and the thick matter pump (16), wherein the substructure (30) comprises a support structure (31) for supporting the substructure (30) by way of at least one support leg (32) which is horizontally and/or vertically displaceable;

a sensor unit (11) with at least one sensor for capturing at least one item of operational information, and a processing unit (12) for determining a stability parameter of the thick matter conveying system (10) depending on the at least one captured item of operational information, and for establishing an orderly operation of the sensor of the sensor unit (11) which captures the at least one item of operational information, wherein, if the processing unit (12) does not establish an orderly operation of the sensor, the processing unit (12) determines the stability parameter depending on an extreme value of the at least one item of operational information to be captured by the sensor instead of the at least one captured item of operational information.

2. The thick matter conveying system (10) of claim 1, further comprising:

a communication interface; and/or a first user interface;

wherein the communication interface and the user interface are each specified to capture the extreme value or an extreme value range of the at least one item of operational information to be captured by the sensor.

3. The thick matter conveying system (10) of claim 2, comprising at least a second user interface indicating a momentary value of the at least one item of operational information to be captured by the sensor, wherein the communication interface or the first user interface is specified to capture the momentary value of the at least one item of operational information to be captured by the sensor, and wherein the processing unit (12) determines the stability parameter depending on the momentary value of the at least one item of operational information to be captured by the sensor.

4. The thick matter conveying system (10) of claim 1, wherein the sensor unit (11) comprises at least one position sensor for capturing an item of operational information indicative of a position of one of the mast arms (41).

5. The thick matter conveying system (10) of claim 1, wherein the slewing gear (19) and a first mast arm (41) of the mast assembly (40) as well as two of the mast arms (41) are connected to one another by way of an articulated joint, respectively, and wherein the position of a mast arm (41) is continuously detectable by determining the opening angle of the articulated joint, at a proximal end of the mast arm (41).

6. The thick matter conveying system (10) of claim 1, wherein the sensor unit (11) comprises at least one leg position sensor for capturing an item of operational information indicative of a position of the support leg (32).

7. The thick matter conveying system (10) of claim 1, wherein the sensor unit (11) comprises at least one angle sensor for capturing an item of operational information indicative of a position of the slewing gear (19).

8. The thick matter conveying system (10) of claim 1, wherein the sensor unit (11) comprises at least one position sensor for capturing an item of operational information indicative of an inclination angle of the thick matter conveying system (10).

9. The thick matter conveying system (10) of claim 1, wherein the sensor unit (11) comprises at least one distance sensor for capturing an item of operational information indicative of an extension of the thick matter conveying system (10).

10. The thick matter conveying system (10) of claim 1, wherein the sensor unit (11) comprises at least one leg force sensor for capturing an item of operational information indicative of a horizontal or vertical leg force of the support leg (32).

11. The thick matter conveying system (10) of claim 1, wherein the sensor unit (11) comprises at least one sensor for capturing an item of operational information indicative of a load torque of one, a plurality of, or all mast arms (41).

12. The thick matter conveying system (10) of claim 11, wherein the sensor unit (11) comprises a cylinder pressure sensor and/or a cylinder force sensor on a bottom side or on a rod side of an A-cylinder of the mast assembly (40).

13. The thick matter conveying system (10) of claim 1, further comprising a control unit (13) for emitting a first control signal if the determined stability parameter of the thick matter conveying system (10) is greater than a maximum stability parameter of the thick matter conveying system (10), and for emitting a second control signal if the determined stability parameter of the thick matter conveying system (10) is less than or equal to the maximum stability parameter of the thick matter conveying system (10).

14. The thick matter conveying system (10) of claim 13, wherein the control unit (13) limits an operating range of the mast assembly (40) to a currently permissible operating range if the determined stability parameter of the thick matter conveying system (10) is greater than the maximum stability parameter.

15. The thick matter conveying system (10) of claim 1, wherein the substructure (30) is arranged on a vehicle (33).

16. A method (100) for operating a thick matter conveying system (10) comprising a thick matter pump (16) for conveying a thick matter, a thick matter distributor mast (18) for distributing the thick matter to be conveyed, a substructure (30) on which are disposed the thick matter distributor mast (18) and the thick matter pump (16), a sensor unit with at least one sensor for capturing at least one item of operational information, and a processing unit (12), wherein the thick matter distributor mast (18) has a slewing gear (19) which is rotatable about a vertical axis and a mast assembly (40) comprising at least two mast arms (41), and wherein the substructure (30) comprises a support structure (31) for supporting the substructure (30) by way of at least one horizontally and/or vertically displaceable support leg (32), the method comprising the following steps:

capturing (101) at least one item of operational information;

establishing (102), by the processing unit (12), an orderly operation of the sensor of the sensor unit (11) that captures the at least one item of operational information;

if an orderly operation of the sensor is not established, determining (104), by the processing unit (12), a stability parameter of the thick matter conveying system (10) depending on an extreme value of the at least one item of operational information to be captured by the sensor instead of the at least one captured item of operational information; and otherwise, determining (103), by the processing unit (12), the stability parameter depending on the at least one captured item of operational information.

17. The method (100) of claim 16, comprising the further steps:

emitting (105), by a control unit (13) of the thick matter conveying system (10), a first control signal if the determined stability parameter of the thick matter conveying system (10) is greater than a maximum stability parameter of the thick matter conveying system (10); and emitting (106), by the control unit (13), a second control signal if the determined stability parameter of the thick matter conveying system (10) is less than or equal to the maximum stability parameter of the thick matter conveying system (10).

18. The method (100) of claim 16, wherein the control unit (13) limits an operating range of the mast assembly (40) to a currently permissible operating range if the determined stability parameter of the thick matter conveying system (10) is greater than a maximum stability parameter of the thick matter conveying system (10).

* * * * *